United States Patent [19]

Everett

[11] Patent Number: 4,684,094

[45] Date of Patent: Aug. 4, 1987

[54] ADJUSTABLE BRACKET ASSEMBLY

[75] Inventor: Lynn E. Everett, New Philadelphia, Ohio

[73] Assignee: Tusco Manufacturing Co., Gnadenhutten, Ohio

[21] Appl. No.: 857,523

[22] Filed: Apr. 23, 1986

Related U.S. Application Data

[63] Continuation of Ser. No. 648,829, Sep. 10, 1984, abandoned.

[51] Int. Cl.[4] ..... A47F 5/00

[52] U.S. Cl. ..... 248/245; 248/222.1; 248/224.4; 211/187

[58] Field of Search ..... 248/225.1, 243, 222.1, 248/224.4, 245, 73, 72; 211/186, 187

[56] References Cited

U.S. PATENT DOCUMENTS 3,353,684 11/1967 Chesley ..... 211/187
3,469,810 9/1969 Dorris ..... 248/228
3,783,320 1/1974 Clements ..... 248/243
4,049,230 9/1977 Minniear ..... 248/222.1

FOREIGN PATENT DOCUMENTS 779813 3/1964 Canada ..... 211/187

*Primary Examiner*—Reinaldo P. Machado
*Assistant Examiner*—Alvin Chin-Shue
*Attorney, Agent, or Firm*—Marshall & Melhorn

[57] ABSTRACT

An adjustable bracket assembly having a pair of longitudinally spaced tab members, each including a notched portion in mirrored image to the other for insertion in spaced slots of a support member. One of the tab members includes a threaded stud and the other tab member includes a sleeve through which the stud passes. A nut, threadly mounted on the threaded stud adjacent the free end of the sleeve, is rotatable to adjust the spacing between the tab members to correspond to the spacing between a pair of slots in the support member. The notched portions of each tab member includes a tapered surface for enabling the tab members to be secured to support members having varying wall thicknesses.

1 Claim, 2 Drawing Figures

ADJUSTABLE BRACKET ASSEMBLY

This is a continuation of application Ser. No. 648,829 filed Sept. 10, 1984, now abandoned.

BACKGROUND OF THE INVENTION

This invention generally relates to bracket members having longitudinally spaced locking tabs to be mounted in appropriate spaced apart slots in a vertically extending support rail and, more particularly, to an adjustable bracket assembly including facing tab members which are longitudinally movable towards and away from one another for cooperation with pairs of spaced apart longitudinally extending slots provided in the associated support rail.

A wide variety of adjustable shelving systems are commonly used in retail stores, factories, warehouses, offices, libraries and the like. Many of these shelving systems include vertically disposed, spaced apart support rail members each having a number of longitudinally spaced slots for receiving spaced locking tabs of shelf supporting brackets for supporting shelves at a variety of heights. Such shelving systems are manufactured by a multitude of companies and, typically, the spacing of the locking tabs and cooperating slots in the associated support rail members of the shelving systems produced by the different companies are seldom uniform. Accordingly, it is desirable to produce an adjustable bracket assembly which can be used with a variety of differently spaced slots provided in support members.

SUMMARY OF THE INVENTION

Briefly, the adjustable bracket assembly constructed in accordance with the invention includes a first tab member insertable in one of a pair of longitudinally spaced slots provided in a support rail member, a second tab member insertable in the other slot of the pair of slots and means for moving the tab members towards and away from one another for securing the tab members to the associated support rail member.

BRIEF DESCRIPTION OF THE DRAWING

The above, as well as other advantages of the invention, will become readily apparent to one skilled in the art from reading the following detailed description of a preferred embodiment of the invention when considered in the light of the accompanying drawing, in which.

DESCRIPTION OF THE PREFERRED EMBODIMENT

Figure 1:
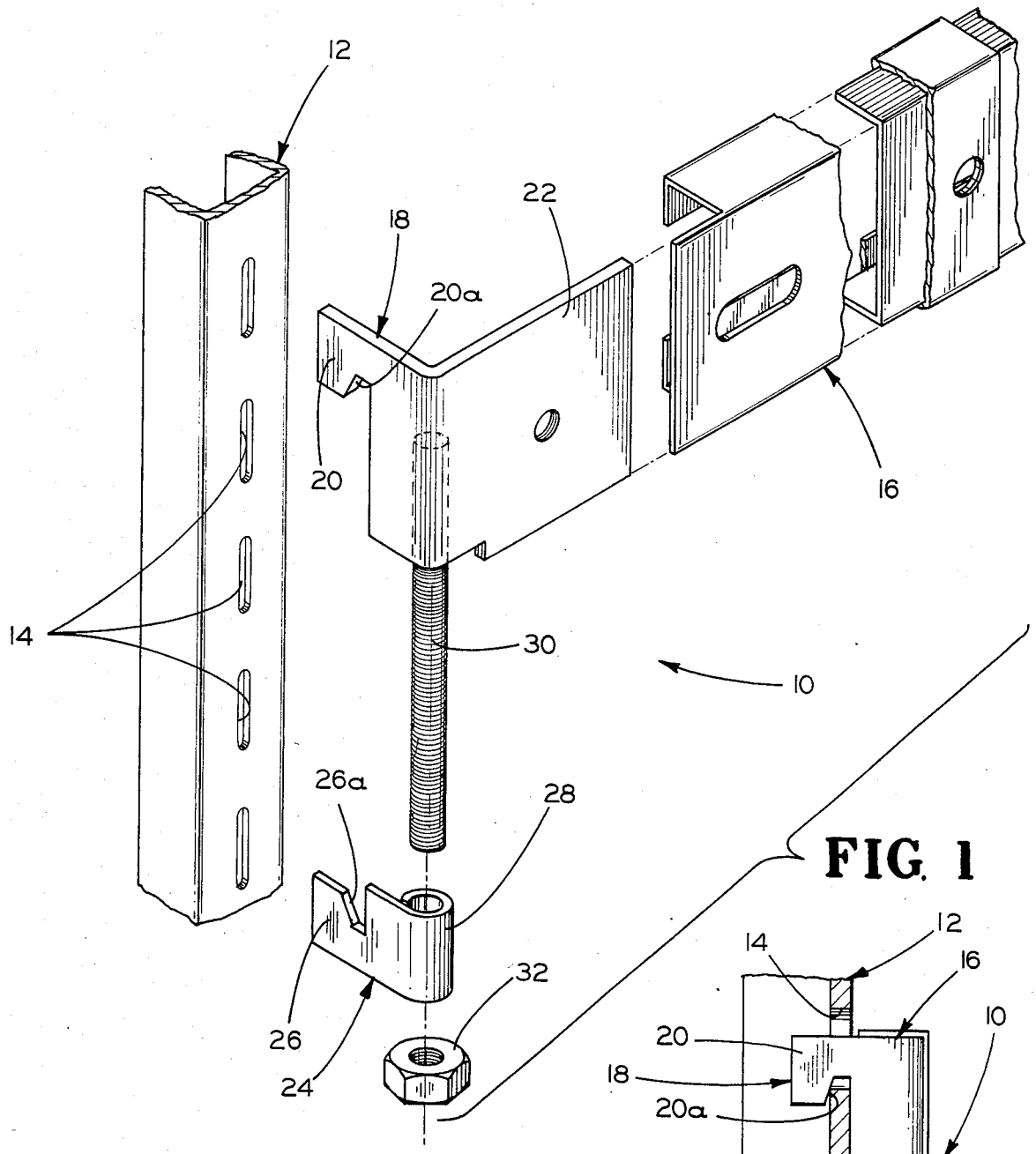
FIG. 1 is an exploded perspective view of an adjustable bracket constructed in accordance with the invention, together with a shelving support member and a vertically oriented support member.
Figure 2:
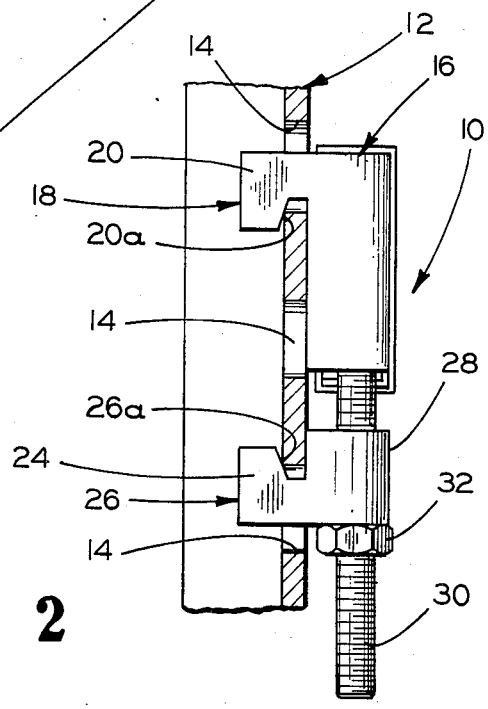
FIG. 2 is a view, partly in section, illustrating the element shown in FIG. 1 in assembled relation.

Referring to the drawings wherein like reference numerals designate similar parts throughout, there is illustrated an adjustable bracket assembly designated in its entirety by the reference numeral 10, a vertically oriented support rail member 12 having a longitudinal axis and a number of longitudinally extending spaced slots 14, and a shelving support or header assembly 16.

The bracket assembly 10 may be attached to the support rail member 12 by means of a first tab or plate member 18, of L-shaped in cross-section and having a notched leg portion 20 for insertion into one of the slots 14; and an associated angularly disposed leg portion 22 for receiving and supporting one end of the header assembly 16. A second tab or plate member 24 having a notched leg portion 26 in mirrored image to the notched leg portion 20 is employed for insertion into a spaced apart slot 14. As shown in FIG. 1, the leg portion 26 extends tangentially from a longitudinally extending cylindrical sleeve portion 28 integral with the tab member 24. The leg portions 20 and 26 are located in a common plane generally parallel to the longitudinal axis of the rail member 12. The sleeve portion 28 integral with the tab member 24 is provided to receive a threaded stud 30 which depends from the tab member 18 to enable adjustment in the spacing between the first and second tab members 18 and 24 in association with a cooperating nut 32.

As illustrated, the threaded stud 30 depends from the juncture of the leg portions 20 and 22 of the first tab member 18. The stud 30 can be fixedly secured to the tab member 18 by welding, for example. The stud 30 passes through the sleeve portion 28 and the nut 32 is threadedly mounted on the end of the stud 30 adjacent the lower end of the sleeve portion 28. The nut 32 is rotatable in a direction to adjust the spacing between the first and second tab members 18 and 24 to secure the notched leg portions 20 and 26, respectively in cooperating slots 14 of the support rail member 12. Further, the notched leg portions 20 and 24 are typically tapered as at 20*a* and 24*a*, respectively, to enable the tab portions 18 and 24 to be secured to support rail members of varying wall thicknesses.

In operation, the uppermost tab member 18 is typically initially suitably hooked or positioned within a slot 14 of the support rail member 12 at the desired height. Next, the lower tab member 24 is positioned at the appropriate level by sliding the sleeve portion 28 thereof along the length of the threaded stud 20 and hooked into a suitably aligned slot 14 of the support rail member 12 at a position beneath the upper tab member 18. It must be understood that an arrangement similar to that illustrated is associated with the opposite end of the header 16. Thus, the header 16 may be positioned at any desired level along the length of the associated spaced apart support rail members 12.

In accordance with the provisions of the patent statutes, the principle and mode of operation of the invention has been explained and what is considered to represent its preferred embodiment has been illustrated and described. It should, however, be understood that the invention may be practiced otherwise than as specifically illustrated and described without departing from its spirit and scope.

What is claimed is:

1. An adjustable bracket assembly for attachment to an elongate support member having a longitudinal axis and at least a pair of longitudinally spaced slots, comprising:

(a) a first generally L-shaped plate member having a first leg located in a plane generally parallel to the longitudinal axis of the support member and provided with a tapered notched tab portion insertable in one slot of the pair of slots, said first plate member having a second leg angularly disposed relative to said first leg and adapted to be secured to an assembly to be supported relative to the elongate support member;

(b) a second plate member longitudinally spaced from said first plate member and having one end formed to define a generally cylindrical, longitudinally extending sleeve and a second end extending generally tangentially from said sleeve and located in said plane, said second end provided with a tapered notched tab portion in facing relationship with said tab portion of said first plate member and insertable in a second one of the pair of slots;

(c) longitudinally extending threaded stud means fixedly attached to one side of said first leg of said first plate member and passing through said sleeve of said second plate member; and (d) nut means threaded on said stud means adjacent said second plate member for moving said first and second plate members toward each other whereby the notched tab portions of said first and said second plate members cooperate with opposite sides of their respective slots to detachably secure said plate members to the elongate support member.

* * * * *